US008869341B2

(12) United States Patent
Bayham

(10) Patent No.: US 8,869,341 B2
(45) Date of Patent: Oct. 28, 2014

(54) HANDLE FOR SECURING INTERCHANGEABLE LOOFAHS

(71) Applicant: Steven S. Bayham, Toms River, NJ (US)

(72) Inventor: Steven S. Bayham, Toms River, NJ (US)

( * ) Notice: Subject to any disclaimer, the term of this patent is extended or adjusted under 35 U.S.C. 154(b) by 0 days.

(21) Appl. No.: 13/815,940

(22) Filed: Mar. 18, 2013

(65) Prior Publication Data

US 2013/0247320 A1 Sep. 26, 2013

Related U.S. Application Data

(60) Provisional application No. 61/685,631, filed on Mar. 22, 2012.

(51) Int. Cl.
*A47K 7/02* (2006.01)
*A47L 17/08* (2006.01)

(52) U.S. Cl.
CPC ..... *A47K 7/028* (2013.01)
USPC ..... 15/210.1; 15/209.1; 15/229.13

(58) Field of Classification Search
CPC ..... A47K 7/02; A47K 7/028; A47K 7/03; A47L 17/08
USPC ..... 15/209.1, 229.13, 210.1
See application file for complete search history.

(56) References Cited

U.S. PATENT DOCUMENTS

| | | | | |
|---|---|---|---|---|
| 5,003,659 | A * | 4/1991 | Paepke | 15/229.13 |
| 5,386,609 | A * | 2/1995 | Xenos | 15/222 |
| 6,119,296 | A * | 9/2000 | Noe et al. | 15/104.94 |
| 6,616,364 | B2 * | 9/2003 | Katz et al. | 401/6 |
| 6,983,866 | B2 * | 1/2006 | Smart et al. | 222/192 |
| 2006/0174914 | A1 * | 8/2006 | Murphy, Jr. | 134/6 |

* cited by examiner

*Primary Examiner* — Randall Chin
(74) *Attorney, Agent, or Firm* — Clifford G. Frayne

(57) ABSTRACT

A handle for temporarily securing a man-made loofah to aid in bathing and showering those parts of the body which are hard to reach, the handle having an elongate gripping end, and having a man-made loofah securing end defined by a plurality of embedded, upstanding bristle members having flexible, crook-shaped upper ends for engaging the perforated mesh cloth of a man-made loofah for scrubbing those portions of the body not easily reached, the man-made loofah easily removed from the handle by a pulling action temporarily deforming the crook-shaped bristle end and releasing the man-made loofah.

6 Claims, 4 Drawing Sheets

HANDLE FOR SECURING INTERCHANGEABLE LOOFAHS

RELATED APPLICATIONS

Applicant claims the benefit of provisional application Ser. No. 61/685,631, filed Mar. 22, 2012.

BACKGROUND OF THE INVENTION

1. Field of the Invention

The present invention relates to loofahs which are used for bathing and showering, and in particular, to the loofahs which are constructed of man-made fiber interwoven into mesh cloth which is then tied or knotted, and a handle which allows these type of loofahs to be interchanged and secured to the handle for bathing and showering those parts of the body difficult to reach.

2. Description of the Prior Art

A natural loofah is any of several tropical vines of the genus *luffa*, of the gourd family which bear large elongated fruit. The dried natural fibrous interior of this fruit is utilized in bathing and showering as a sponge. The natural fiber loofah is semi-rigid when dry, but when wet, softens. The absorption of water and the application of soap allows the user to exfoliate dead skin from his body and invigorate and encourage the growth of new skin while showering or bathing. The natural fiber loofahs are produced in hand-held versions, and also are produced with an affixed handle which allows the user to reach those portions of the torso which are difficult to reach.

The popularity of loofahs and their usage has led to the development of man-made loofahs. These loofahs are formed from man-made fibers formed into perforated mesh cloth which are folded upon themselves and tied so as to form a ball-like structure having a plurality of furls extending there from. An example of the man-made loofah may be found in design patent 423,144 to Sun. The man-made loofahs function identically with respect to the exfoliation of skin and the invigoration of skin as do the natural fiber loofahs. However, the man-made fiber loofahs do not lend themselves easily to being affixed to a permanent handle.

The problem which Applicant addresses is that in a multi-user household, multiple members of the family would have their own man-made loofah for bathing those parts of the body easily reached. However, in order to lather and scrub the back, a separate loofah having an elongate handle or a separate bristle brush having an elongate handle would be required in order to reach the back of the individual. Depending upon the number of members in the household, a significant amount of paraphernalia in the form of man-made loofahs, and brushes, would accumulate in the shower or bath area. It would therefore be desirable if an individual's single man-made loofah could be adapted for scrubbing and lathering those parts of the body easily reached and temporarily securable to a handle for reaching those portions of the body not easily reached. In this manner, a single handle could be utilized and interchanged with multiple man-made loofahs from multiple users without adding to the bathing paraphernalia surrounding the tub or shower.

OBJECTS OF THE INVENTION

An object of the present invention is to provide for a novel handle which is temporarily securable to a man-made loofah to allow the user to scrub and lather those portions of the body not easily reached.

A further object of the present invention is to provide for a novel handle temporarily securable to a man-made loofah which allows different man-made loofahs utilized by different individuals to be interchanged on the same handle without requiring multiple handled loofahs A still further object of the present invention is to provide for a novel handle which does not deleteriously affect the structure of the loofah when being secured and unsecured to the handle.

SUMMARY OF THE INVENTION

A handle for temporarily securing a man-made loofah to aid in bathing and showering those parts of the body which are hard to reach, the handle having an elongate gripping end, and having a man-made loofah securing end defined by a plurality of embedded, upstanding bristle members having flexible, crook-shaped upper ends for engaging the perforated mesh cloth of a man-made loofah for scrubbing those portions of the body not easily reached, the man-made loofah easily removed from the handle by a pulling action temporarily deforming the crook-shaped bristle end and releasing the man-made loofah.

BRIEF DESCRIPTION OF THE DRAWINGS

These and other objects of the present invention will become apparent, particularly when taken in light of the following illustrations wherein.

DETAILED DESCRIPTION OF THE INVENTION

Figure 1:
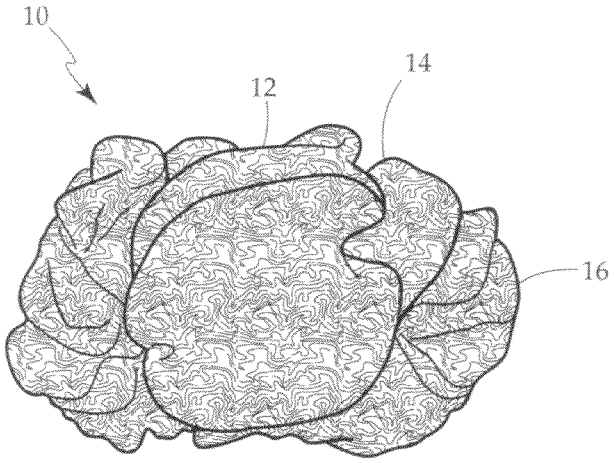
FIG. 1 is a perspective view of a man-made loofah to which the current invention applies.

FIG. 1 is a perspective view of a man-made loofah 10 to which the current invention applies. The man-made loofah 10 is formed of man-made fibers interwoven into a perforated mesh-like cloth 12. This mesh-like cloth 12 is then folded upon itself and tied or knotted in its central area 14 to the size of a small ball with a plurality of furls 16 which are the ends of the man-made fiber's cloth extending there from. The man-made loofah 10 is water absorbent and the mesh cloth retains soap which is applied thereto for bathing or showering. The construction of the man-made loofah 10 does not lend itself easily to being secured to a permanent handle for bathing hard to reach body parts as does a natural loofah.

Figure 2:
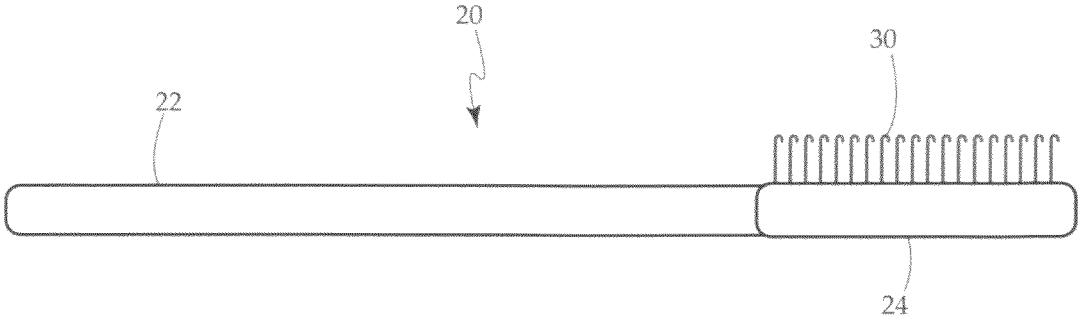
FIG. 2 is a side view of the handle of the present invention.
Figure 3:
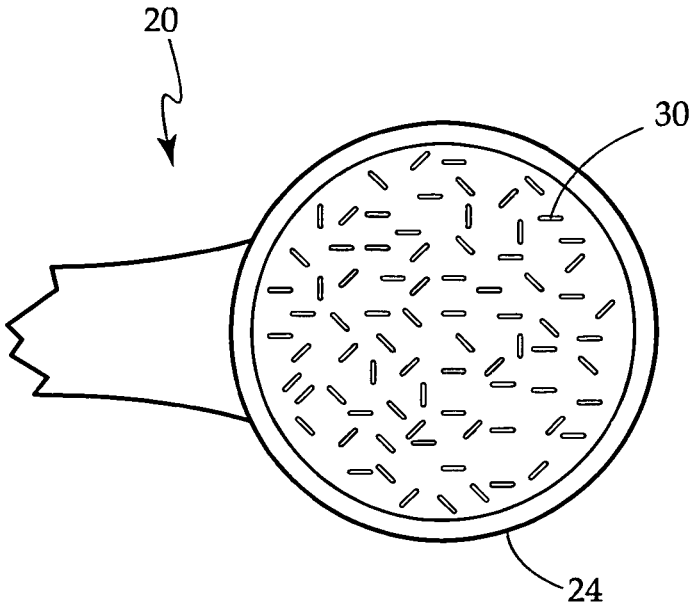
FIG. 3 is a top view of the handle of the present invention.
Figure 4:
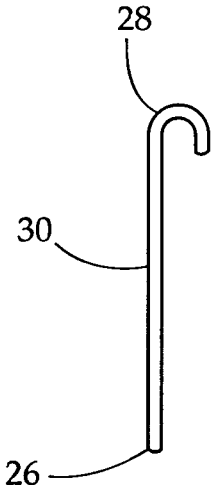
FIGS. 4, 4A and 4B are side views of embodiments of a bristle.
Figure 4A:
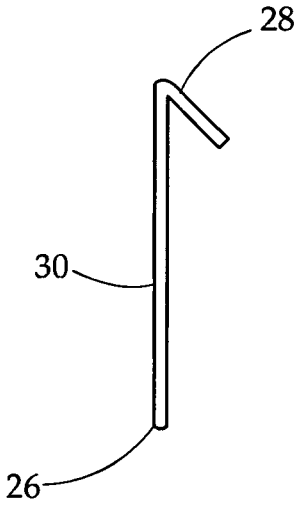
Figure 4B:
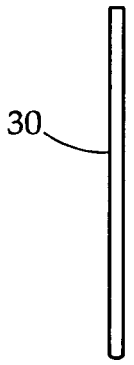

FIG. 2 is a side view of the handle of the present invention and FIG. 3 is a top view of the handle of the present invention. Handle 20 is elongate, having a gripping end 22 and a loofah securing end 24. Loofah securing end 24 is illustrated as being circular in shape having a plurality of upstanding bristles 30 embedded therein. Bristles 30 are defined by a straight embedded end 26 and an upstanding crook end 28 (see FIGS. 4 and 4A). Crook end 28 of bristles 30 provide a gripping surface by randomly, selectively interlocking with the man-made loofah and the perforated mesh-like cloth 12 from which it is formed similar to a hook and loop fastener to maintain the man-made loofah in contact with loofah securing end 24 while scrubbing hard to reach body locations. The crook end 28 may be an inverted U-shape as illustrated in FIG. 4, or it may be a downward angular bend as illustrated in FIG. 4A. The importance is that the crook end 28 act as a hook in engaging the man-made loofah 10 to the handle 20. Bristle 30 as illustrated in FIG. 4B does not have a crook end. It is straight and slightly thicker than the crook end bristles and provides lateral stability between the handle and the loofah.

The user now has a man-made loofah 10 secured to handle 20 such that the user can hold the gripping end 22 of the handle 20 and apply soap and water to the man-made loofah and reach those body parts, such as the back, which are not easily reached with a hand held, man-made loofah. When the user is finished bathing or showering, the user merely applies slight pulling pressure to the man-made loofah 10 to temporarily deform upstanding crook end 28 and easily remove it for subsequent use as a hand held loofah. Handle 20 is thereafter available for another family member to use with his or her man-made loofah to bath and clean those body portions not easily reached.

Handle 20, and gripping end 22 and loofah securing end 24 may be made of one piece unitary construction out of either a rigid polymer or semi-rigid material. Bristles 30 may be embedded directly into loofah securing end 24. Handle 20 has no sharp edges so that it is safe to use in a slippery environment as might be found in a shower or bath.

Figure 5:
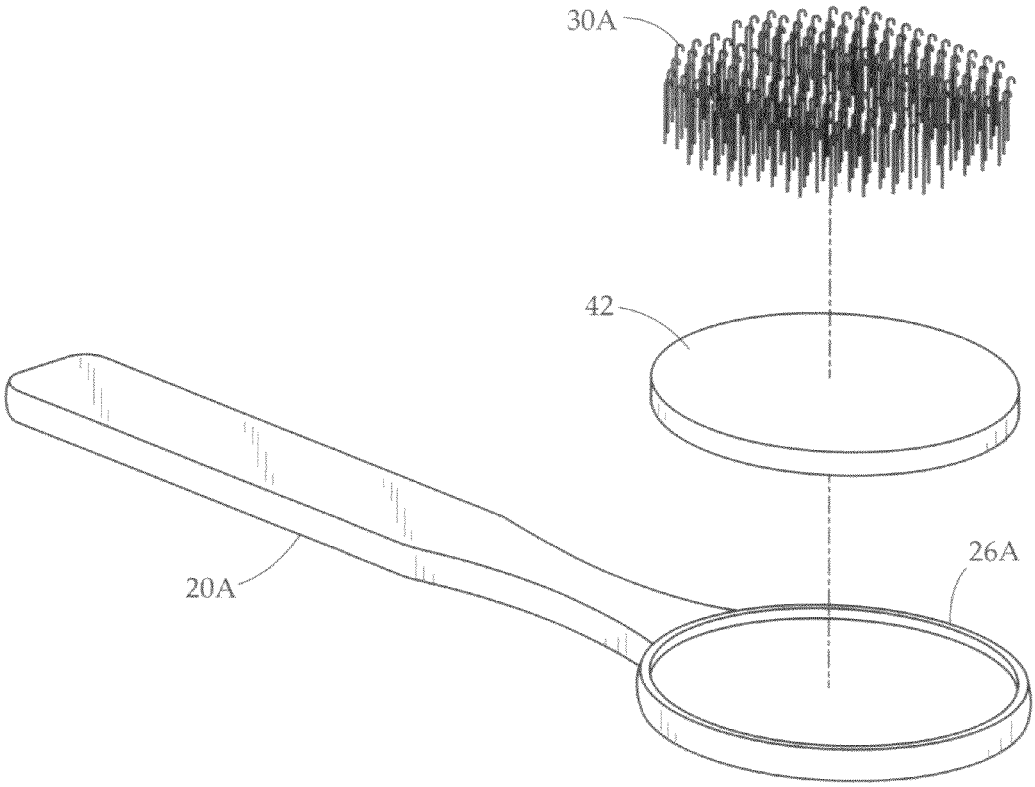
FIG. 5 is an exploded view of a second embodiment of a handle of the present invention.

In a separate embodiment, (see FIG. 5) for possible ease of manufacture and fabrication, handle 20A is identical to the first embodiment with the exception that the bristles 30A are now formed in a separate circular bristle base element 42 which is then inserted into cavity 26A of handle 20A and secured in place by adhesive or other suitable means. All aspects of use of the second embodiment of the handle 20A are identical with the first embodiment.

Figure 6:
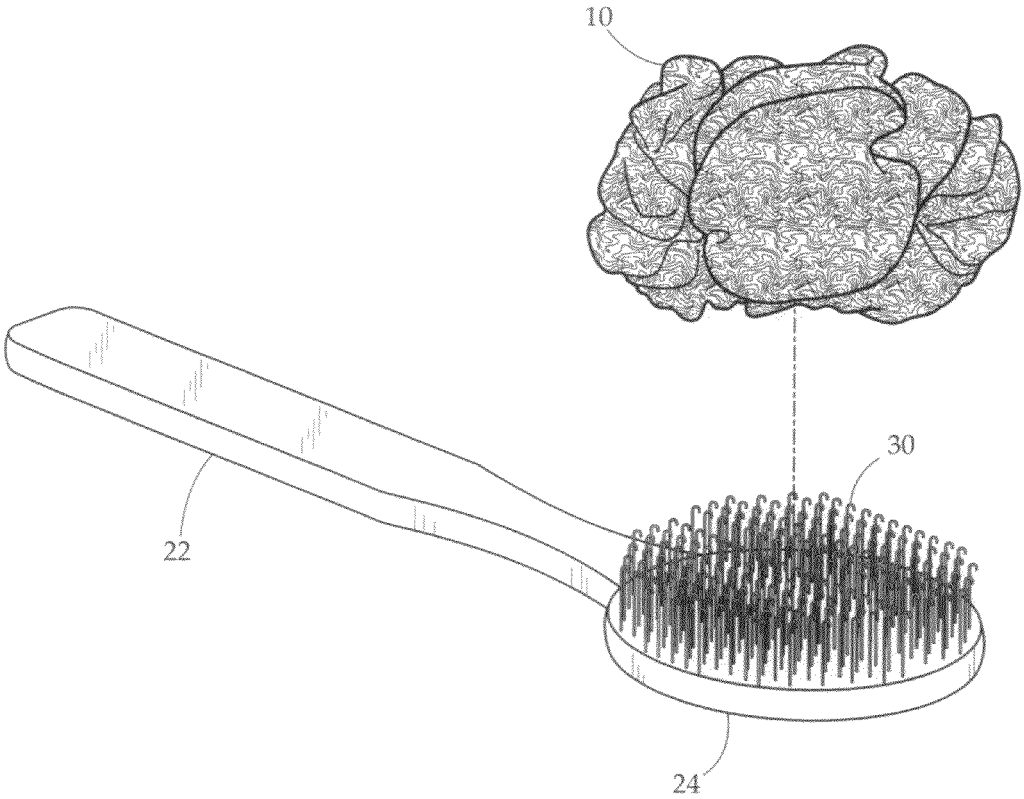
FIG. 6 is a perspective view of the handle of the present invention with a man-made loofah being engaged therewith.

FIG. 6 is a perspective view of handle 20 with man-made loofah 10 being engaged therewith for cleaning and scrubbing the back of an individual.

For exemplary purposes, the loofah securing end 24 of handle 20 has been illustrated as being circular in configuration. Loofah securing end 24 may be configured with a different geometric shape without departing from the scope and spirit of the invention. Such geometric shape could be oval, square, or triangular, or any other suitable geometric shape. Additionally, while the handle 20 has been illustrated as one piece construction with the gripping end and the loofah securing end, it is within the scope of the invention that the gripping end and the loofah securing end could be of two part construction such that should the bristles 30 become worn, the loofah securing end 24 might be detached from the gripping end 22 and replaced obviating the need for replacement of the complete handle.

Therefore, while the present invention has been disclosed with respect to the preferred embodiments thereof, it will be recognized by those of ordinary skill in the art that various changes and modifications can be made without departing from the spirit and scope of the invention. It is therefore manifestly intended that the invention be limited only by the claims and the equivalence thereof.

I claim:

1. A handle member for securing a man-made loofah for use in bathing, said handle member comprising:

a first handle end, and a second loofah engaging end, said loofah engaging end having a periphery defining a centrally positioned depression, said depression for the receipt of a base member secured thereto, said base member having a plurality of upstanding flexible bristles extending upwardly from said base member, a lower end of said bristle being securely embedded in said base member, an upper end of said bristle being crook-shaped providing said bristle with a hook-shape, said bristles randomly positioned about the entire surface of said base member, said crook-shaped portion of said flexible bristle, engageable and disengageable with a mesh fabric material utilized to form a man-made loofah selectively securing said man-made loofah to said loofah engaging end of said handle member for use in bathing, said flexible bristles allowing for the selective removal and replacement of said man-made loofah when bathing is complete.

2. The handle member for securing a man-made loofah in accordance with claim 1 wherein said upper end of said bristle being crook-shaped is configured in the shape of an inverted U.

3. The handle member for securing a man-made loofah in accordance with claim 1 wherein said upper end of said bristle being crook-shaped is configured in the shape of an acute downwardly facing angle.

4. Man-made loofah and handle member comprising:

a man-made loofah fabricated from a perforated mesh fabric;

a handle member having a first handle end and a second loofah engaging end, said loofah engaging end having a periphery defining a centrally positioned depression, said depression for the receipt of a base member secured thereto, said base member having a plurality of upstanding flexible bristles extending upwardly from said base member, a lower end of said bristle being securely embedded in said base member, an upper end of said bristle being crook-shaped providing said bristle with a hook-shape, said bristles randomly positioned about the entire surface of said base member, said crook-shaped portion of said flexible bristle, engageable and disengageable with a mesh fabric material utilized to form said man-made loofah selectively securing said man-made loofah to said loofah engaging end of said handle member for use in bathing, said flexible bristles allowing for the selective removal and replacement of said man-made loofah when bathing is complete.

5. The man-made loofah and handle member for securing a man-made loofah in accordance with claim 4 wherein said upper end of said bristle being crook-shaped is configured in the shape of an inverted U.

6. The man-made loofah and handle member for securing a man-made loofah in accordance with claim 4 wherein said upper end of said bristle being crook-shaped is configured in the shape of an acute downwardly facing angle.

* * * * *